US006437465B1

(12) United States Patent
Nishimura et al.

(10) Patent No.: US 6,437,465 B1
(45) Date of Patent: Aug. 20, 2002

(54) ROTARY BRUSH DEVICE AND VACUUM CLEANER USING THE SAME

(75) Inventors: Hiroshi Nishimura, Shiga; Seizo Hayashi, Oumihachiman, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/061,702

(22) Filed: Feb. 1, 2002

Related U.S. Application Data

(60) Division of application No. 09/286,340, filed on Apr. 5, 1999, which is a continuation-in-part of application No. 09/055,020, filed on Apr. 3, 1998, now abandoned.

(51) Int. Cl.[7] ..... H02K 7/00; H02K 7/14; A47L 9/22; A47L 11/00

(52) U.S. Cl. ..... 310/47; 310/50; 310/154; 15/52.1; 15/412; 15/519

(58) Field of Search ..... 310/47, 50, 154; 15/52.1, 412, 413, 416, 319, 339

(56) References Cited

U.S. PATENT DOCUMENTS

| | | | | |
|---|---|---|---|---|
| 1,438,443 A | | 12/1922 | Lieberherr et al. | 15/412 |
| 1,770,643 A | | 7/1930 | Giambertoni | 15/52.1 |
| 1,834,059 A | | 12/1931 | Hopkins et al. | 51/170 PT |
| 3,089,047 A | | 5/1963 | Perzyk | 10/239 |
| 3,172,138 A | | 3/1965 | Price | 15/98 |
| 3,344,291 A | | 9/1967 | Pratt | 310/50 |
| 3,618,687 A | | 11/1971 | Ripple et al. | 180/19.3 |
| 3,619,948 A | | 11/1971 | Burns | 51/72 |
| 3,652,879 A | | 3/1972 | Plunkett et al. | 310/50 |
| 3,665,227 A | | 5/1972 | Busch | 310/46 |
| 3,702,488 A | | 11/1972 | Kasper | 15/50.3 |
| 3,907,257 A | | 9/1975 | Drzewiecki | 451/358 |
| 4,079,597 A | | 3/1978 | Lindner et al. | 64/5 |
| 4,268,769 A | | 5/1981 | Dorner et al. | 310/67 R |
| 4,384,386 A | | 5/1983 | Dorner et al. | 15/377 |
| 4,590,635 A | | 5/1986 | Tucker et al. | 15/50.1 |
| 4,654,924 A | | 4/1987 | Getz et al. | 15/319 |
| 4,977,639 A | * | 12/1990 | Takahashi et al. | 15/319 |
| 5,255,409 A | | 10/1993 | Fujiwara et al. | 15/319 |
| 6,323,570 B1 | * | 11/2001 | Nishimura et al. | 15/392 |

FOREIGN PATENT DOCUMENTS

| | | |
|---|---|---|
| DE | 19706239 | 4/1998 |
| EP | 467347 | 1/1992 |
| GB | 293319 | 9/1928 |
| GB | 370645 | 4/1932 |
| GB | 668631 | 3/1952 |
| JP | 07313411 | 12/1995 |
| JP | 08038400 | 2/1996 |

OTHER PUBLICATIONS

European Search Report dated Jan. 7, 2002, Application No. EP99 10 6662.

* cited by examiner

*Primary Examiner*—Nestor Ramirez
*Assistant Examiner*—Dang Dinh Le
(74) *Attorney, Agent, or Firm*—RatnerPrestia

(57) ABSTRACT

A motor is incorporated in a cylindrical body which is a rotary brush. Rotation of a rotor of the motor, directly or via a speed reduction mechanism, drives the rotary brush. Cooling air runs through the cylindrical body so that the motor is cooled and protected. The rotary brush and an electric apparatus using the rotary brush can be downsized and easily.

3 Claims, 13 Drawing Sheets

ROTARY BRUSH DEVICE AND VACUUM CLEANER USING THE SAME

This application is a divisional of U.S. patent application Ser. No. 09/286,340, filed Apr. 5, 1999, which is a Continuation-In-Part of Application Ser. No. 09/055,020, filed Apr. 3, 1998. (Status: Abandoned).

FIELD OF THE INVENTION

The present invention relates to a rotary brush device used in an electric vacuum cleaner and an electric apparatus using the same.

BACKGROUND OF THE INVENTION

A rotary brush device of a conventional upright vacuum cleaner has been formed with a rotary brush which is housed in a floor nozzle and is driven by an electric blower motor for sucking dust. The motor is built in the main body of vacuum cleaner, and the motor through a belt or gears drives the rotary brush, or a dedicated motor is provided outside the rotary brush somewhere in a floor nozzle to drive the brush.

The conventional construction discussed above requires a considerably large space for the mechanism transmitting the rotating force. This has been a blocking factor for making an apparatus smaller in size and lighter in weight. This also has caused inconvenience of handling the apparatus.

SUMMARY OF THE INVENTION

The present invention addresses the problems discussed above and aims to provide an apparatus where a rotary brush is provided within a cylindrical body forming the rotary brush; the rotary brush is driven by rotating force of a rotor of the motor. The present invention also contains a consideration to an airflow channel for cooling and protecting the motor. Therefore, by employing the invented rotary brush device, a compact and lightweight apparatus can be realized. The apparatus also can be handled with ease.

BRIEF DESCRIPTION OF THE DRAWINGS

FIG. 7(*b*) is a cross sectional side view taken on B—B side of FIG. 3. (A bottom of the apparatus is off the floor.)

FIG. 12(*b*) is a cross sectional side view showing the active floor detector.

FIG. 12(*c*) is an electric circuit diagram of the floor detector.

FIG. 13(*b*) is an electric circuit diagram of the above apparatus.

DETAILED DESCRIPTION OF THE EXEMPLARY EMBODIMENTS

The entire disclosure of U.S. patent application Ser. No. 09/286,340 filed Apr. 5, 1999 is expressly incorporated by reference herein.

Figure 1:
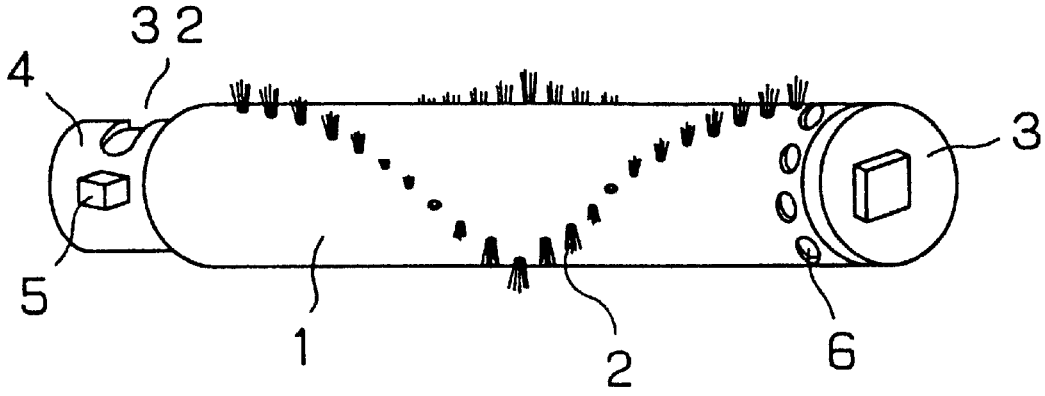
FIG. 1 is a perspective view of a rotary brush device in accordance with an exemplary embodiment of the present invention.

Exemplary embodiments of the present invention are described hereinafter with reference to the accompanying drawings. In FIG. 1, cylindrical body 1 and brush 2 form a rotary brush. Bristles are transplanted in a V-shape on the outer surface of cylindrical body 1 to form brush 2. In place of the brush, an agitator, a thin plate scraper, or the like, may be used depending on objectives or applications. Numeral 3 denotes a reduction gear bracket which is a part of speed reduction mechanism, and a motor bracket 4 holds a motor housed in cylindrical body 1. First opening 6, a ventilation hole, is provided on an edge portion of the outer wall of cylindrical body 1. Numeral 32 denotes a ventilation hole provided in motor bracket 4. The bristle arrangement of brush 2, or agitator, is not limited to the V-shape, but may be of a helical shaped or another patterns for an improved capacity of dust agitation/collection.

Figure 2:
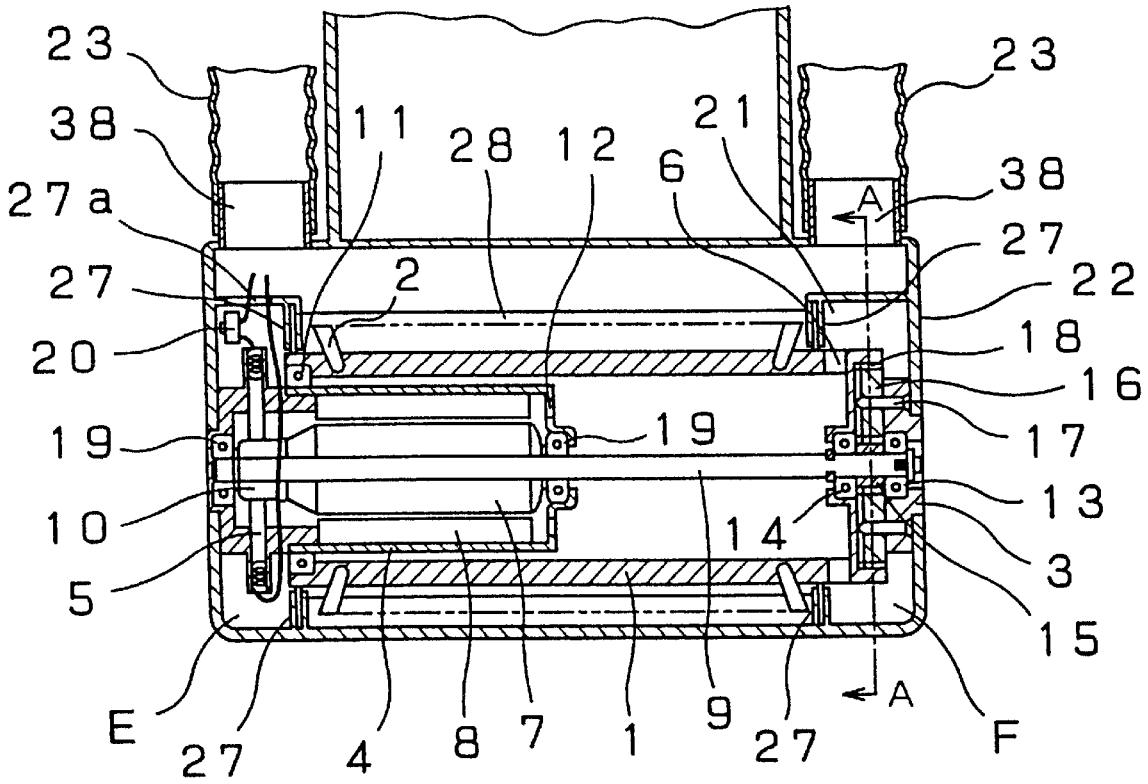
FIG. 2 is a cross sectional top view showing an essential part of an electric apparatus incorporating a rotary brush device of the present invention.

In FIG. 2, numeral 7 denotes a rotor of the motor, stator 8 of the motor is mounted inside of motor bracket 4, and is disposed in an annular space between rotor 7 and bracket 4. Rotor shaft 9 rotates together with the rotor 7. Commutator 10 is disposed on an edge portion of rotor 7 and carbon brush 5 slidably contacts the circumference of commutator 10. Rotor 7 is powered through carbon brush 5 and commutator 10. A first bearing 11 receives the outer ring of motor bracket 4 press-fitted in its inner wall, while an outer ring of bearing 11 is press fitted into an inner wall of cylindrical body 1 at its left edge so that cylindrical body 1 is journaled at the motor end. Carbon brush 5 is mounted to part of motor bracket 4 which outwardly protrudes from cylindrical body 1 at the motor side, i.e. the motor bracket is provided outside of first bearing 11. Carbon brush 5 is mounted outside of rotational cylindrical body 1 so that wiring for power is easily provided to carbon brush 5, and so that a worn-out carbon brush could be easily replaced.

Numeral 12 denotes a third opening provided in the motor bracket 4 at the right end for taking the outside air into the motor for cooling. Numeral 13 denotes a second bearing which is press fitted to reduction gear bracket 3 and supports the right end (opposite end to the motor) of the rotor shaft with the inner ring. Numeral 14 denotes a third bearing the outer ring of which is press fitted to a portion of cylindrical body 1 (a recess on the wall opposite to motor of cylindrical body 1), while rotor shaft 9 is press fitted to the inner ring of the bearing. First gear 15 is fixed to the rotor shaft 9, and is held by and between the second bearing 13 and the third bearing 14. Second gear 16 is supported by pin 17 provided in reduction gear bracket 3, for transmitting the rotation of first gear 15 to third gear 18 formed around the inner edge of cylindrical body 1; thus cylindrical body 1 is driven at a reduced speed. Motor bearings 19 are provided at both ends of the rotor 7, the bearings 19 are held by motor bracket 4.

Figure 10:
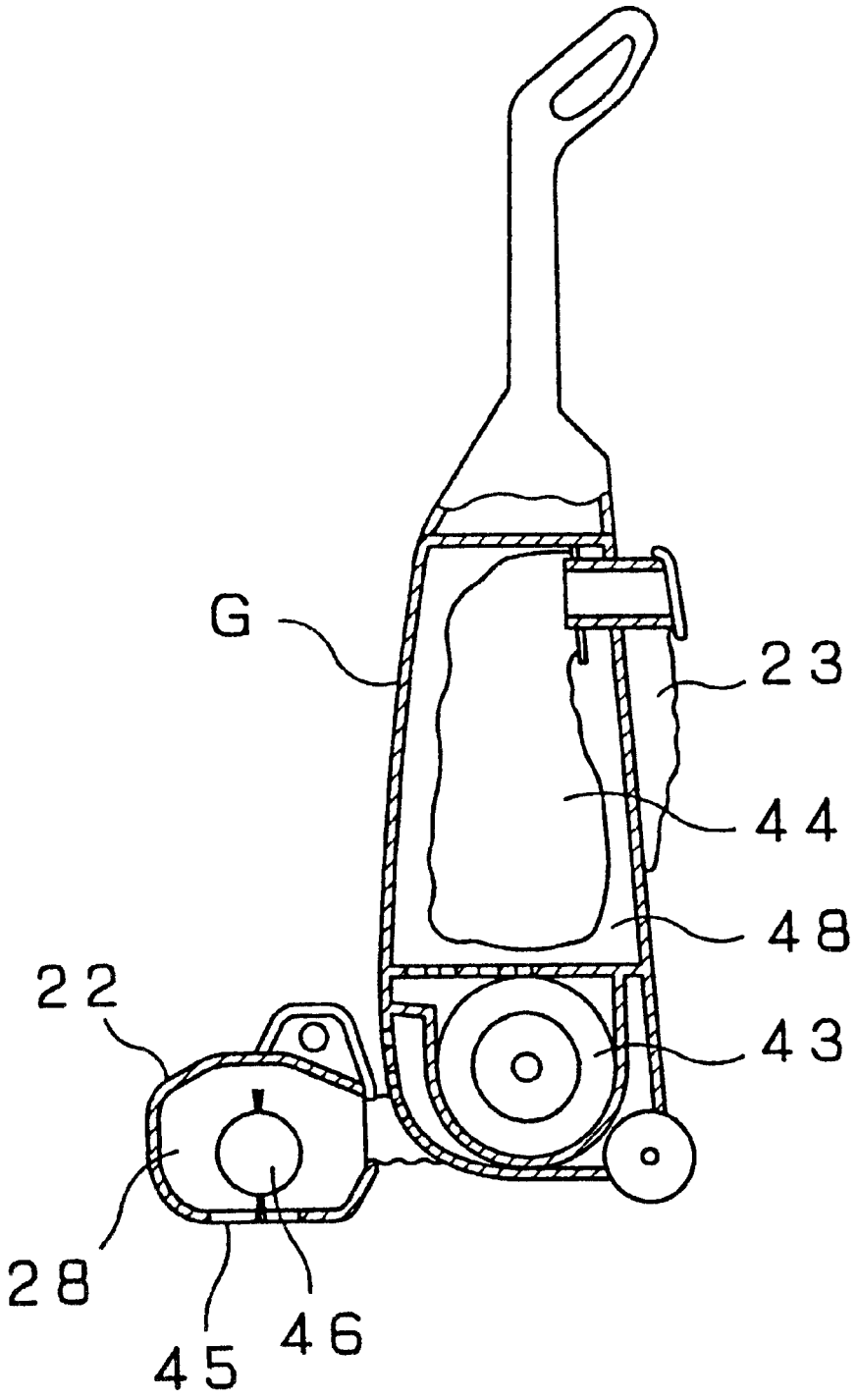
FIG. 10 is a cross sectional side view showing an essential part of the vacuum cleaner shown in FIG. 8.

The structure discussed above allows cylindrical body 11 to rotate in an accurate and smooth manner with less noise and to be journaled by first bearing 11 and third bearing 14. When magnetic permeable material is used to form cylindrical body 11, efficiency of the motor is further promoted. Since heavy items, such as the motor, the reduction gear and its bracket, are placed on both ends of cylindrical body 11 in well balanced manner, cylindrical body 11 rotates with little wobble thanks to the well-balanced weight. Further, heavy items are placed at both ends, i.e. near to the bearings, so that few chances of rotational wobble are available. Detector 20 detects abnormal pressure in a sucking passage, temperature or electric current and breaks electric supply to the motor; thus the detector is expected to function as a safety device for protecting the motor or preventing unusual heat generation. For instance, when dust is caught in the brush it may lock the rotary brush, and the temperature and the current supply to the motor exceeds a normal level. The detector detects these abnormal states so that the motor is protected and overheating is avoided. Sucked in air is utilized to cool down the motor (detailed later). However, when sucking power is lowered because a filter provided in a dust chamber (48 in FIG. 10) is clogged or the like, the detector detects a lowered pressure in the sucking passage. Since the lowered pressure causes insufficient cooling of the motor, the detector can shut the current-supply to the motor to avoid overheat. Outside-air taking room 21 introduces outside-air to first opening 6 provided on cylindrical body 1. Floor nozzle 22 incorporates the rotary brush therein. A first end of hose 23 is coupled to sucking mouth 38 provided at rear portion of floor nozzle 22. A second end of hose 23 leads to dust chamber 48 and electric blower 43, both are situated in the cleaner body that is disposed behind the floor nozzle (Ref. FIG. 10). Partition 27 is protrusively provided in floor nozzle 22 so that partition 27 surrounds both ends of cylindrical body 1. Partition 27 separates sucking chamber 28, outside-air taking room 28 where first opening 6 is situated and a second opening 32 provided on the motor bracket. Chamber 28 is operated by the sucking power of the electric blower. Partition 27 has communication hole 27*a* on second opening 32 side, and the sucking operation is obtained through hole 27*a,* which aims to cool the motor by sucking outside-air through outside-air taking room 21, first opening 6, cylindrical body 1, motor bracket 4 and second opening 32.

The accompanying drawing in accordance with this exemplary embodiment shows two pieces of hose 23. When only one hose 23 is used, communication hole 27*a* can communicate sucking chamber 28 so that sucking power directly works through second opening 32. Therefore, the motor can be cooled down more efficiently. In this case, sucking mouth 38 is placed closely to communication hole 27*a* so that mouth 38 can get strong sucking power. In this case, i.e. with one hose 23, when hose 23 is placed opposite to hole "27*a*", air sucked through second opening 32 and communication hole "27*a*" efficiently transfers the dust collected by brush 2 and moved in sucking chamber 28 laterally into hose 23. The placement of hose 23 opposite to communication hole "27*a*" arranges sucking mouth 38 and first opening 6 on the same side of floor nozzle 22 with regard to lateral direction. The rotary brush is placed in sucking chamber 28, and opening 45 is provided on the bottom of nozzle 22 corresponding to the lower portion of the rotary brush so that the rotary brush faces the floor side.

Figure 3:
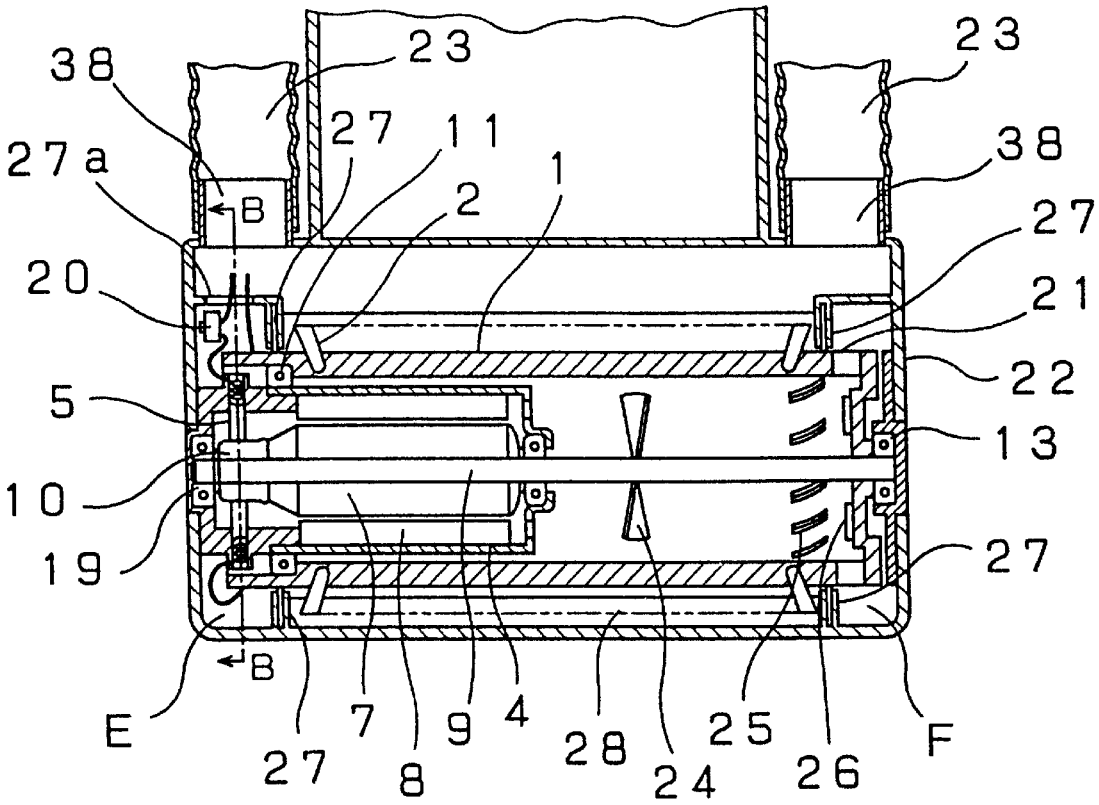
FIG. 3 is a cross sectional top view showing an essential part of an electric apparatus incorporating a rotary brush device in accordance with other embodiment of the present invention.

FIG. 3 illustrates a more compact structure where carbon brush 5 is integrated into cylindrical body 1. This structure allows floor nozzle 22 to utilize its width more effectively, or to be smaller in size. FIG. 3 also illustrates that fin 24 is provided on rotor shaft 9, fin 25 is provided on the inner wall of cylindrical body 11, and fin 26 is protruded on a side wall of cylindrical body 1. These arrangements eliminates the speed reduction mechanism and realizes direct driving as well as blows air inside the motor in the cylindrical body 1 as wind creating means to cool the motor. Each fin can be independently used or combined with each other depending on the cooling effect.

Figure 4:
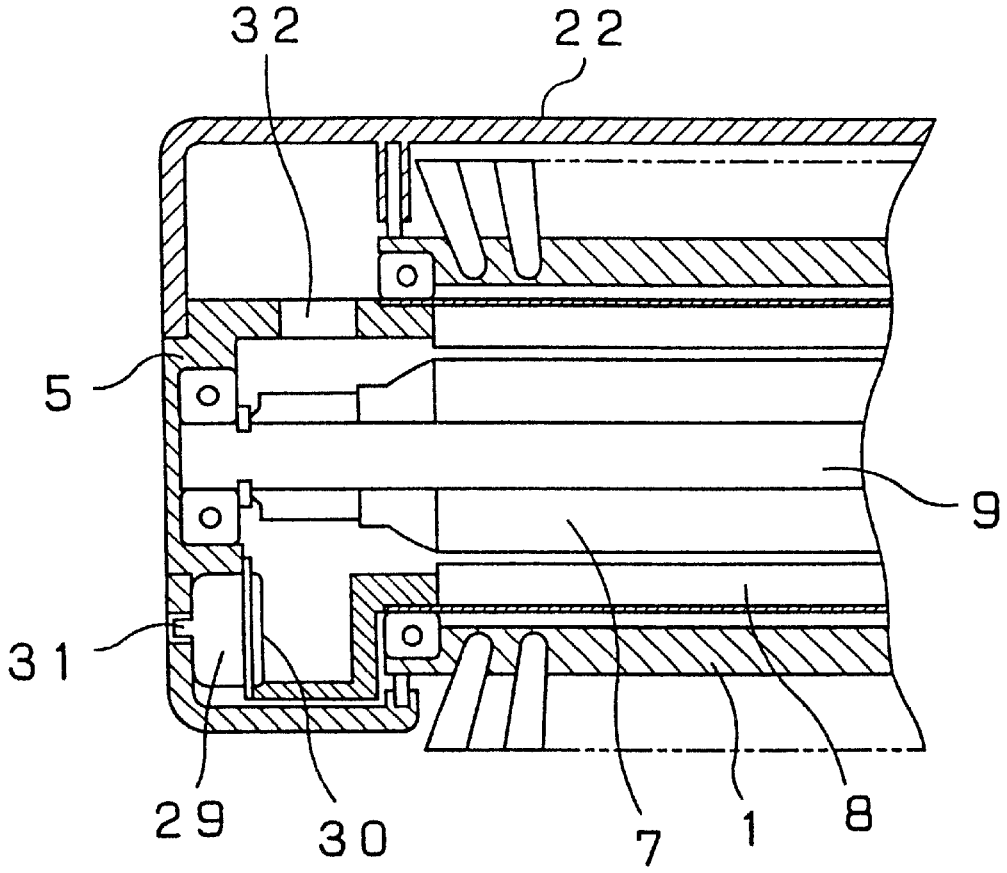
FIG. 4 is a cross sectional side elevation showing an essential part of an electric apparatus incorporating a rotary brush device in accordance with other embodiment of the present invention.

FIG. 4 illustrates that manual reset type thermo-protector 29 functions as a detector. It has heat-sensitive section 30 and manual reset button 31. In an operation, once a temperature rises abnormally, the apparatus stops working, and this manual reset button 31 prevents the apparatus from automatically starting again when the temperature lowers naturally. The apparatus can be started again by operating the manual reset button after identifying the abnormality.

Figure 5:
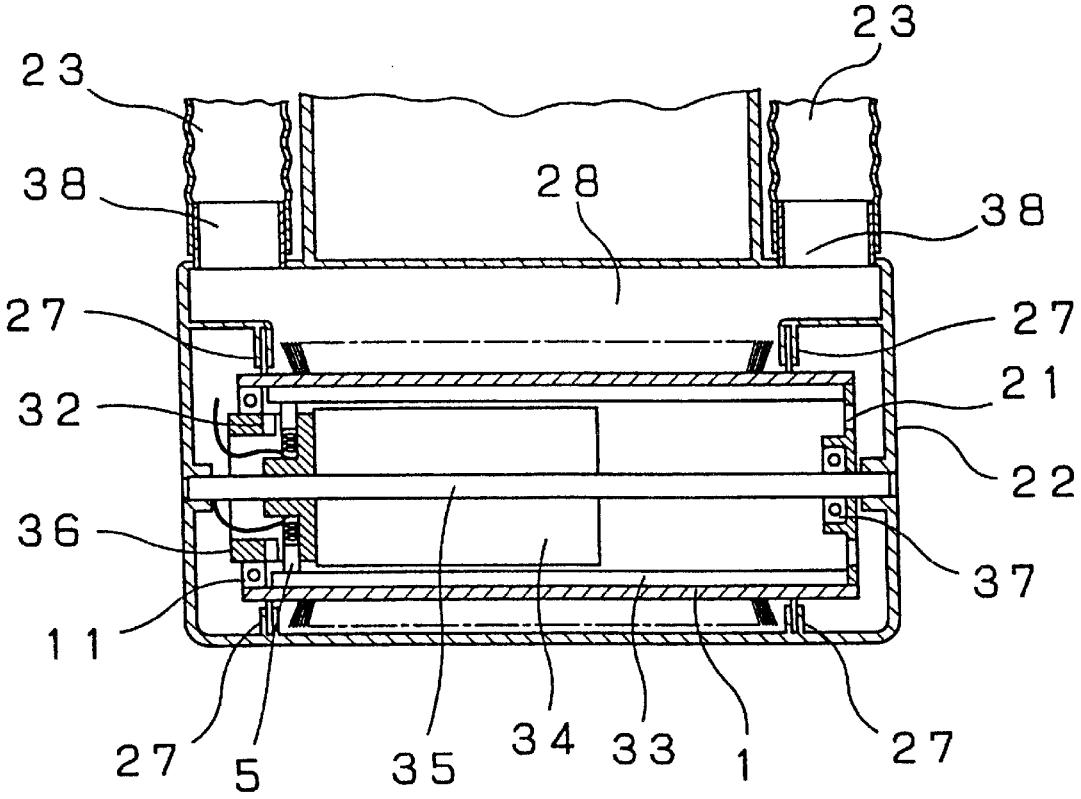
FIG. 5 is a cross sectional top view showing an essential part of an electric apparatus incorporating a rotary brush device in accordance with still other embodiment of the present invention.

FIG. 5 illustrates a rotary brush device incorporating an outer rotor motor. The major point of difference as compared to FIG. 3 includes; rotor 33 comprising a magnet is fitted to inner wall of cylindrical body 1, stator 34 is fixed to motor shaft 35 of which both ends are held and fixed by floor nozzle 22, cylindrical body 1 at the left end is journaled by the outer ring of first bearing 11 which is press fitted in the inner ring with outer wall of stator bracket 36, while at the right end of cylindrical body 1 is journaled with its side wall by bearing 37. Sucking intake 38 for hose 23 to suck the air from sucking chamber 28 of floor nozzle 22. In the present exemplary embodiment, hose 23 has been provided for two. However, there may be one hose 23 only, in which case only one sucking intake may be provided at one end.

Figure 6:
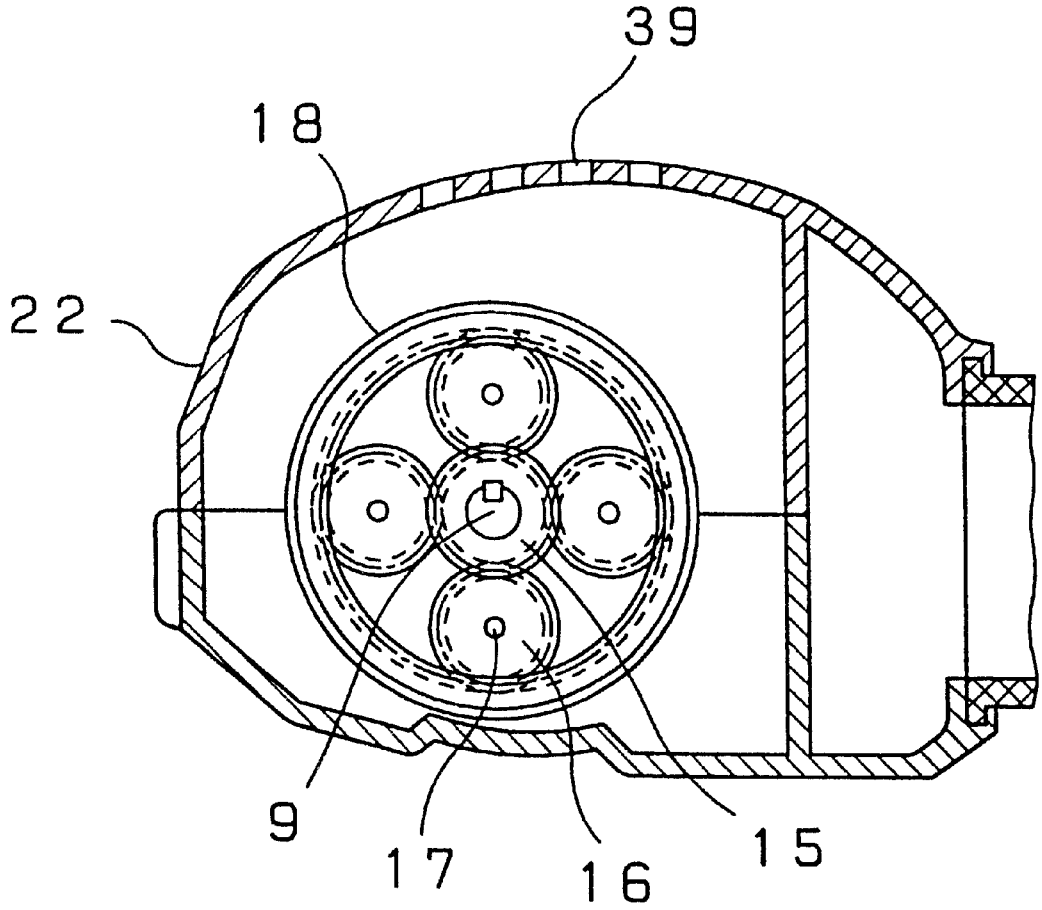
FIG. 6 is a cross sectional side view taken on A—A side of FIG. 2.
Figure 7A:
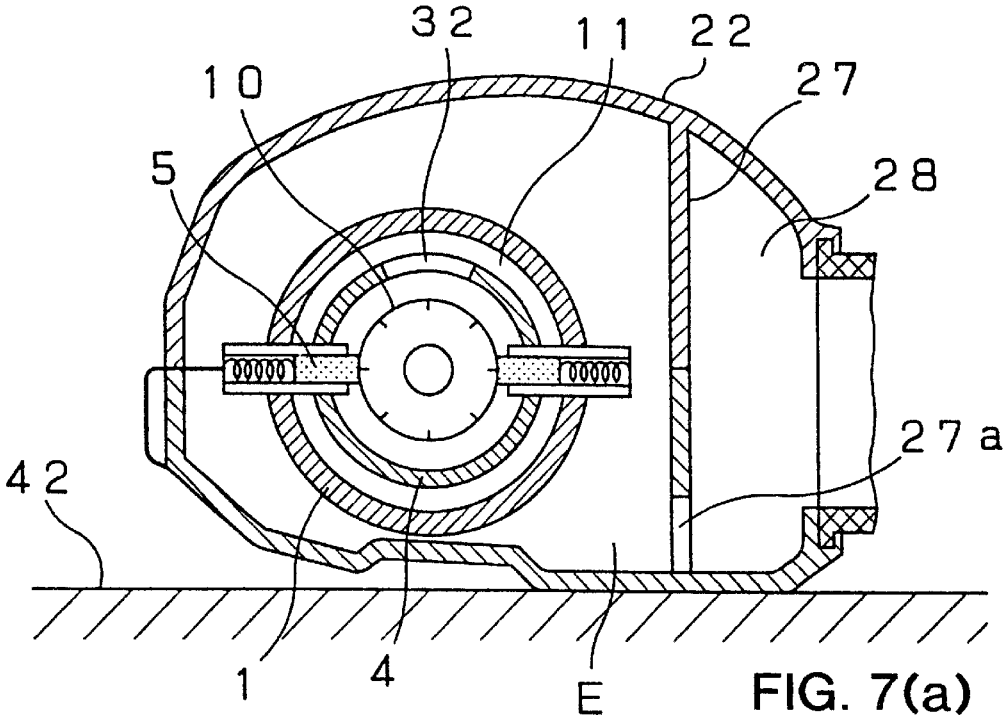
FIG. 7(*a*) is a cross sectional side view taken on B—B side of FIG. 3. (A bottom of the apparatus is on the floor.)
Figure 7B:
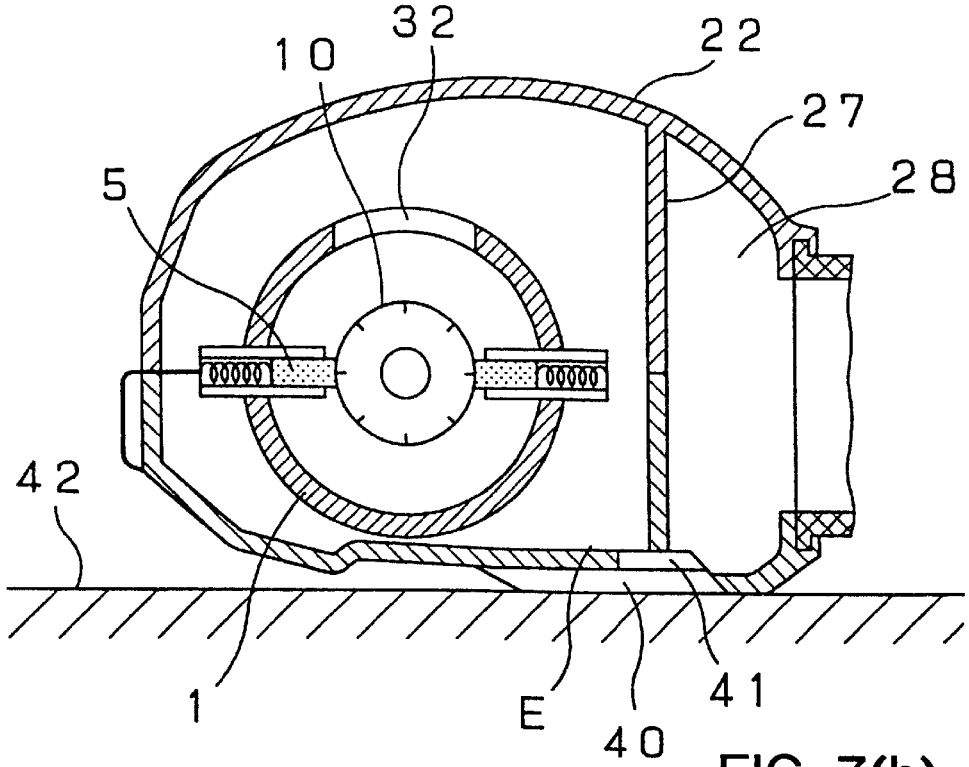
Figure 8:
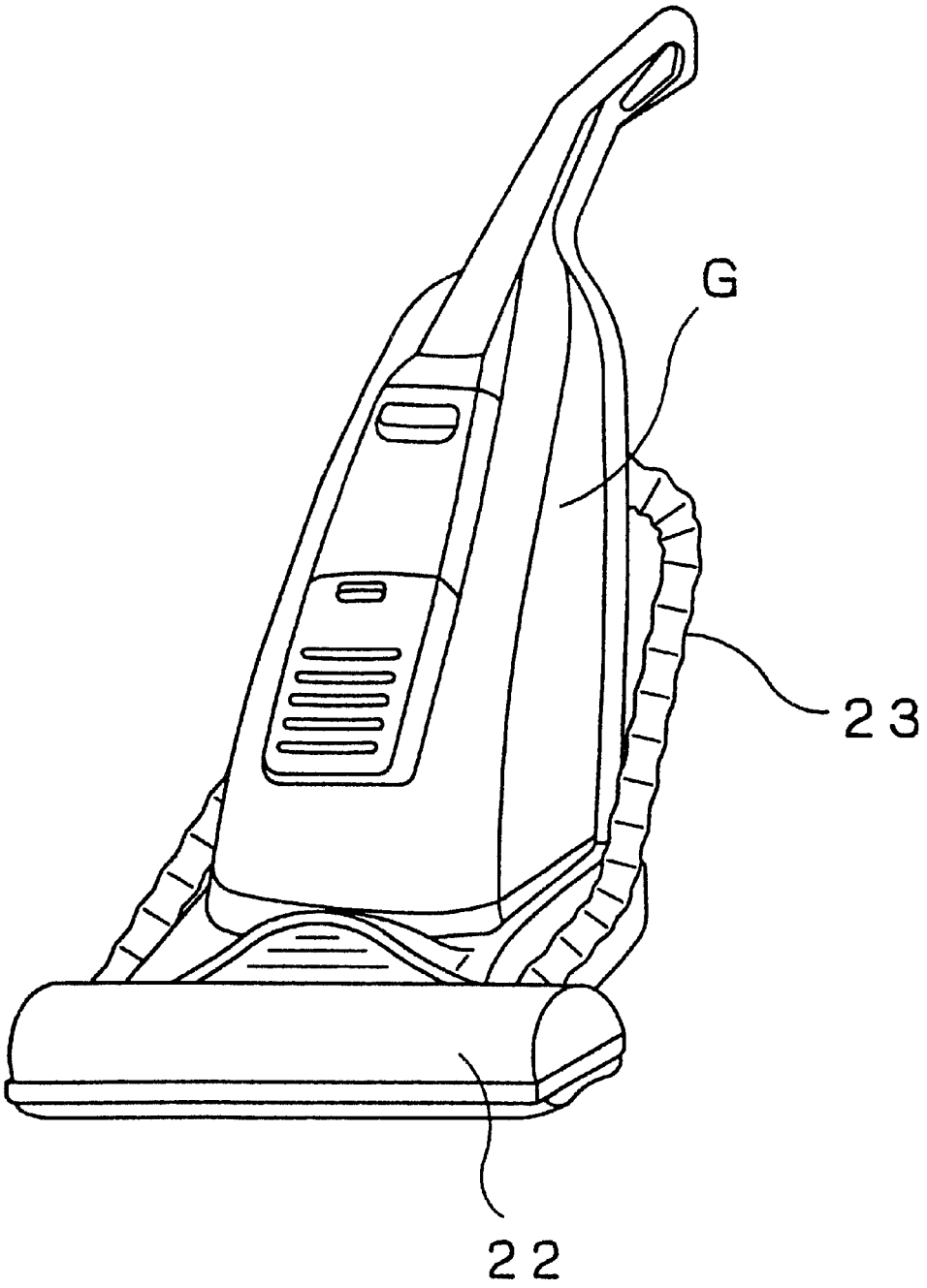
FIG. 8 shows an outlook of an upright vacuum cleaner, an example of electric apparatuses.
Figure 9:
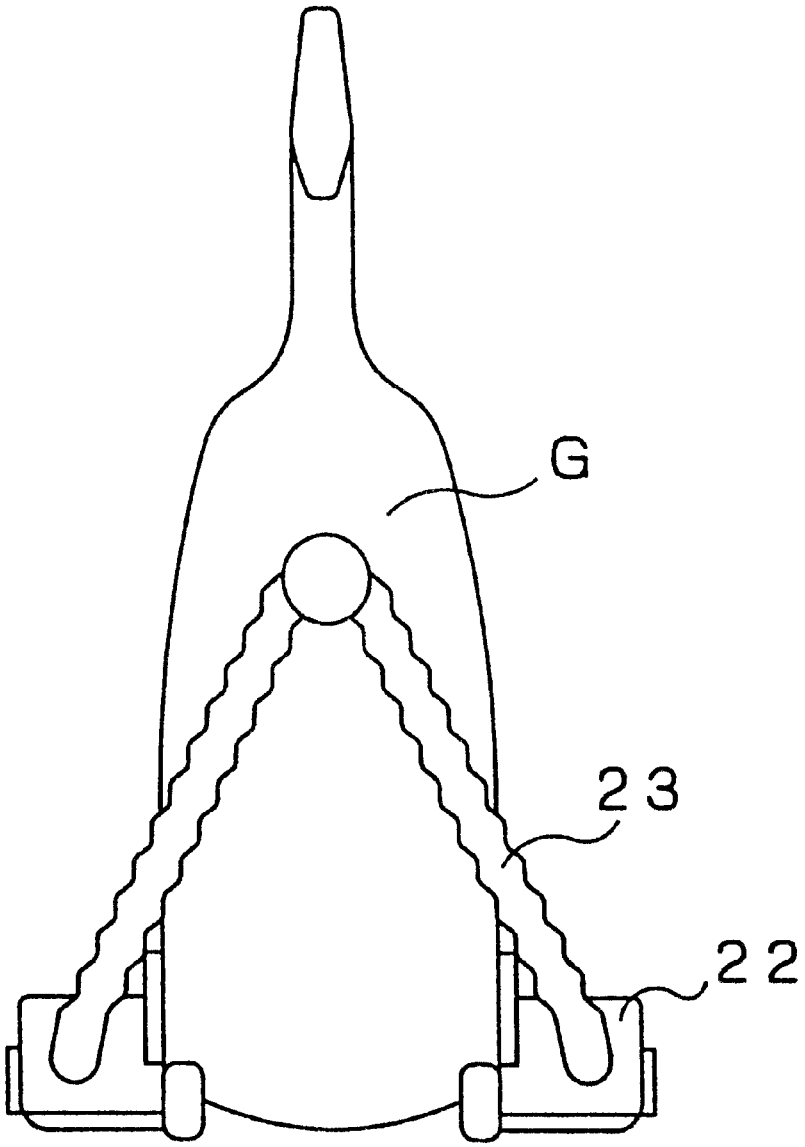
FIG. 9 is a rear view of the vacuum cleaner shown in FIG. 8.

In FIG. 6, outside-air intake 39 is provided on the top portion of floor nozzle 22. The portion where outside-air intake 39 is placed corresponds to space F (ref. FIG. 2) of outside-air taking room 21 separated by partition 27 from sucking chamber 28. While second opening 32 faces space "E" separated from sucking chamber 28 which is placed opposite to outside-air intake 39. As shown in FIG. 7*a,* partition 27 with regard to space "E" has communication hole "27*a*" leading to sucking chamber 28. Therefore, when electric blower 43 exerts its sucking power to sucking chamber 28, sucking power is effected to communication hole "27*a*", second opening 32, inside of cylindrical body 1, first opening 21 and space "F" sequentially, thereby taking outside-air from outside-air intake 39. This outside-air taken inside cools the motor. In FIG. 7(*a*), floor 24 is to be cleaned. In FIG. 7(*b*), recess 40 is provided in the bottom of floor nozzle 22, opening 41 is provided in recess 40. Opening 41 is connected through with space "E" and sucking chamber 28. Consequently, the sucking power of sucking chamber 28 works to space "E", thereby producing airflow indicated by the arrow mark. As a result, motor can be cooled as discussed previously. At the same time, the dust on the floor which recess 40 faces also can be sucked to sucking chamber 28 side. Outside-air intake 39 is provided on the upper face of the floor nozzle so that dust collected by the rotary brush can be restrained from sucking. As a result, the motor can be cooled with cooling air excluding the dust. In FIG. 8 and FIG. 9, vacuum cleaner body "G" incorporates dust chamber 48 and blower 43, and the lower part of the body is mounted to the rear portion of floor nozzle 22 so that body "G" can be arbitrarily slanted.

Figure 11:
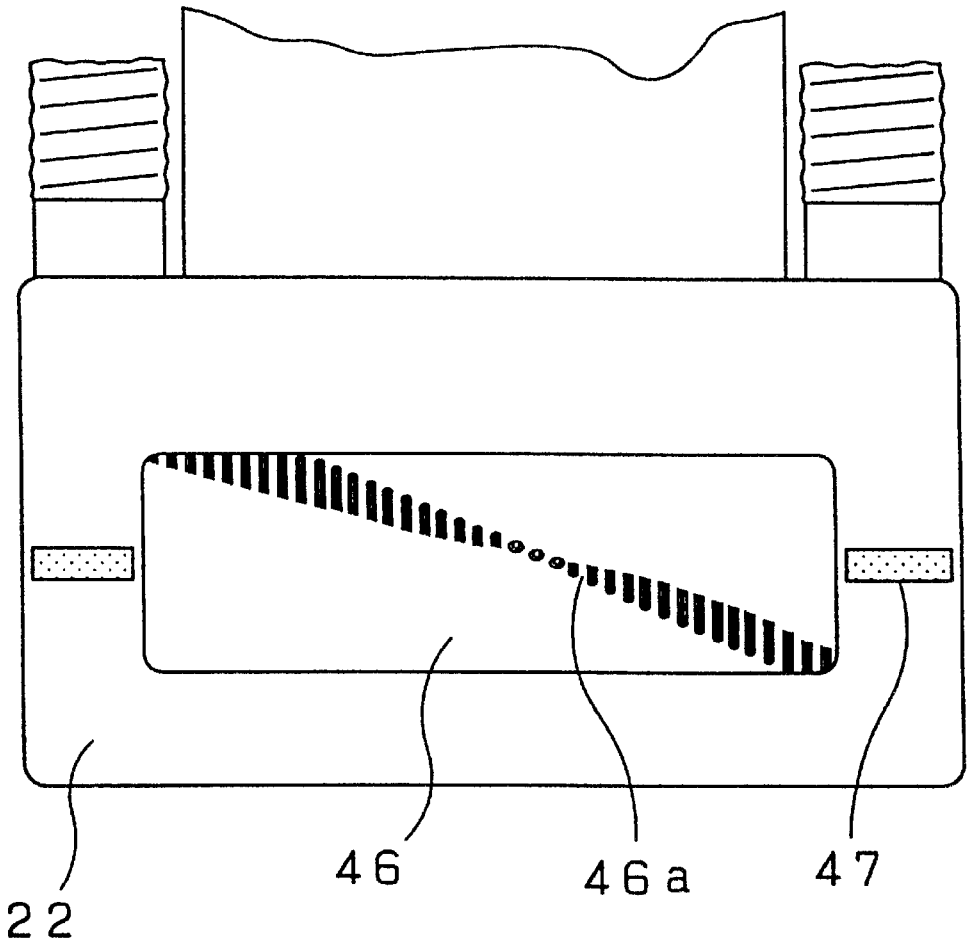
FIG. 11 is a bottom view of an essential part of a floor nozzle of the vacuum cleaner shown in FIG. 8.

In FIG. 10, numeral 43 denotes an electric blower for sucking the air, dust bag 44 is provided within dust chamber 48, sucking mouth 45 is provided on the bottom of nozzle 22, rotary brush 46 is provided within nozzle 22. The floor nozzle and the rotary brush shown in FIG. 1 though FIG. 7 are employed. In FIG. 11, rotary brush "46*a*" has bristles transplanted in a V-shape. Brushes 47 are fixedly mounted at both ends of the sucking mouth 45, and brushes 47 have bristles planted with a certain orientation for picking up lint and the like.

In the above exemplary embodiments the rotary brush is used for only one. It is of course possible to form a rotary brush device employing a plurality of rotary brushes.

Figure 12A:
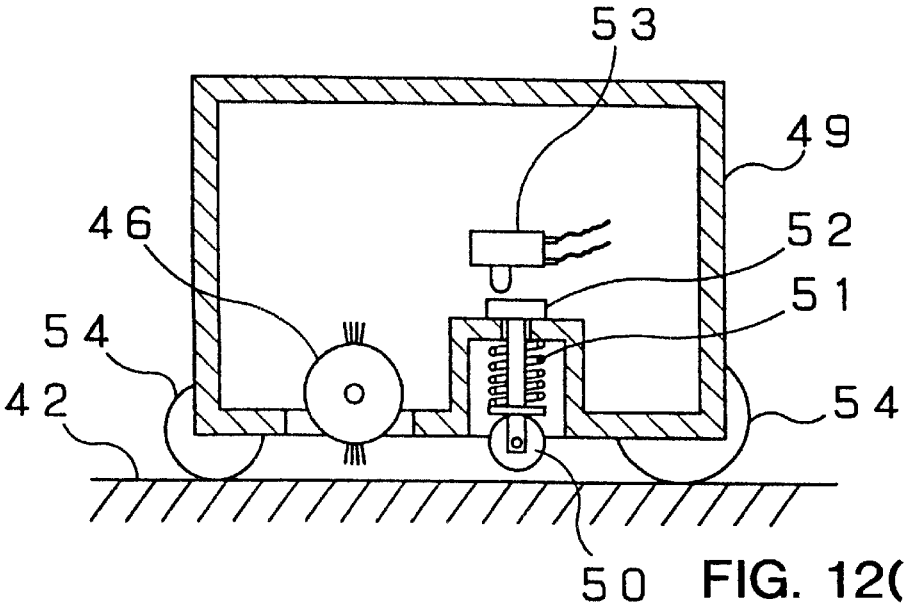
FIG. 12(*a*) is a cross sectional side elevation showing an electric apparatus incorporating a floor detector.
Figure 12B:
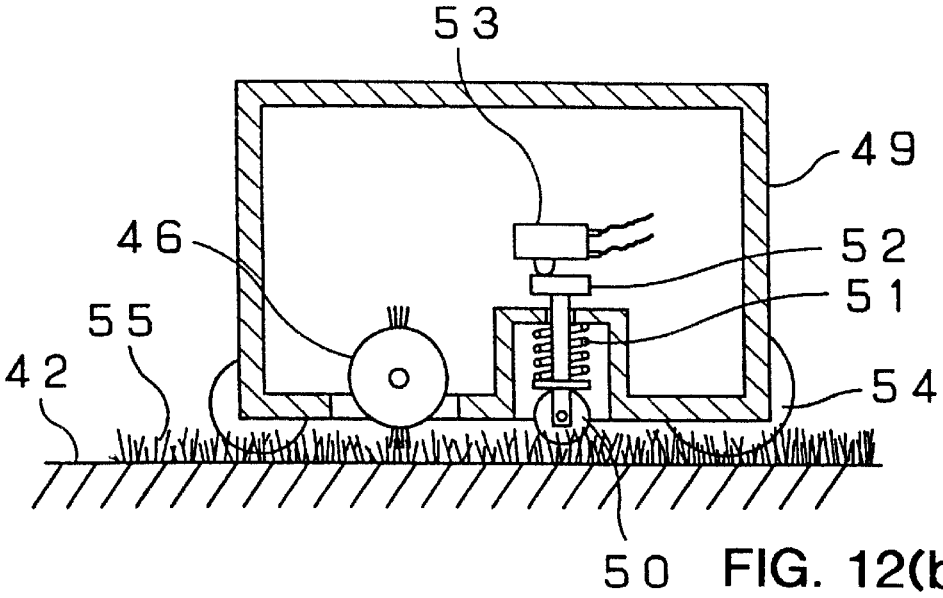
Figure 12C:
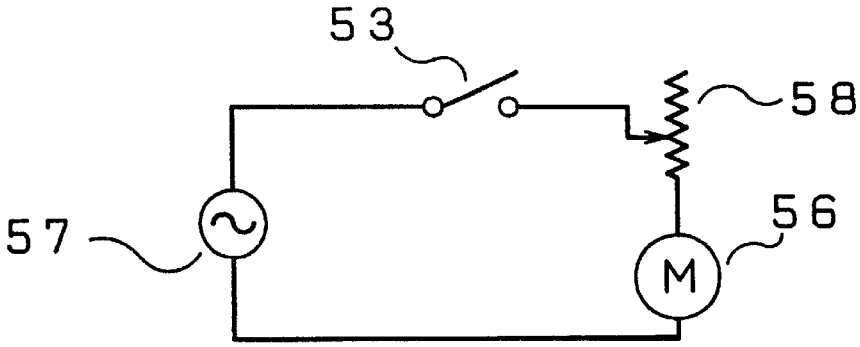

FIG. 12(*a*) includes rotary brush 46 discussed above, and an electric apparatus 49 having a pair of floor rollers 54 in the front and the rear sections respectively incorporating an invented rotary brush device. Floor contact roller 50 is provided at the bottom end of actuator 52 that is urged down by a spring 51. As a result of detection of the floor, floor contact roller 50 is lifted up to turn switch 53, situated in the OFF position, to the ON position which activates a motor built in a rotary brush device. FIG. 12(*b*) illustrates a state where carpet 55 placed on floor 42 is detected and the switch 53 is turned ON. FIG. 12(*c*) is an electrical circuit including power source 57, detection switch 53, motor 56 built in the rotary brush device, and variable resistor 58 for controlling the rotation of the motor which is to be discussed later. An electric vacuum cleaner for floor carpet having the construction discussed above starts operation when floor contact roller 50 is pushed up by carpet 55.

Figure 13A:
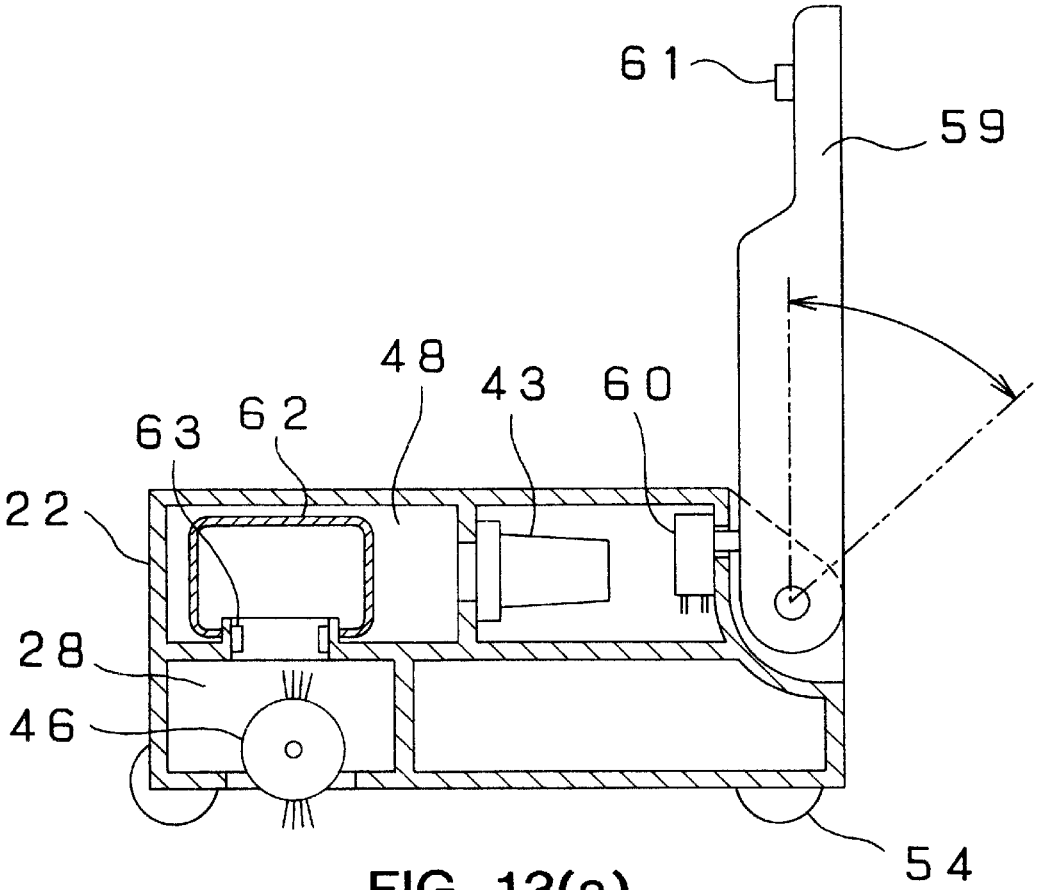
FIG. 13(*a*) is a cross sectional side view of an apparatus provided with a handle and a dust detector in accordance with an exemplary embodiment.
Figure 13B:
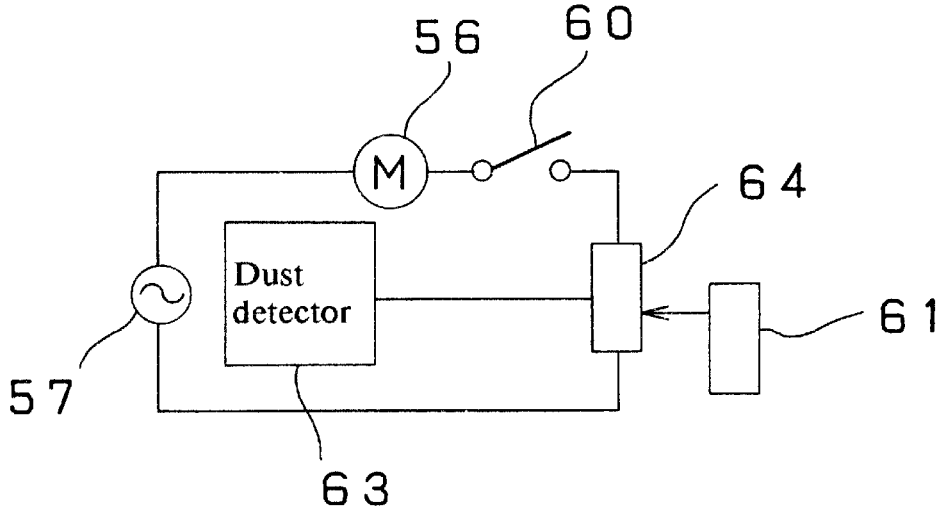

In FIG. 13(*a*), handle 59 is tiltably attached to floor nozzle 22; when it is stood upright, switch 60 is turned OFF to break electric supply to the rotary brush device. Controller 61 is provided on the handle 59, and controls a rotation speed of rotary brush 46 through the above described variable resistor 58. Filter 62 is provided in dust chamber 48 for capturing the dusts stirred by rotary brush 46. Dust detector 63 comprises light-emitting element and light-sensing element, etc. and detects quantity of dusts being sucked into dust chamber 48. The dust detector senses the shift of output from the light-sensing element. The rotation speed of rotary brush 46 is varied in accordance with the dust quantity. FIG. 13(*b*) illustrates the electrical circuit of detector 63; where, phase controller 64 controls the rotation speed of the motor in accordance with result of the above described dust sensing. When controller 61 selects a rotational speed depending on the dust sensing, phase controller 64 follows the control process discussed above. In addition to this, high, mid, and low speeds are prepared so that users can arbitrarily select the rotational speed among them. This structure allows the vacuum cleaner to be handled with ease and work efficiently in terms of power consumption.

What is claimed is:

1. An electric apparatus comprising: a pair of front and rear rollers, a floor detector for detecting a type of floor over which the electric apparatus is rolled, a switch operated by engagement with said floor detector, and a rotary brush device having a cylindrical body with a motor housed in the cylindrical body, an outer wall of the cylindrical body is provided with at least one of a brush, a thin-plate agitator, and a thin-plate scraper, the cylindrical body is provided at one end with a first opening for receiving outside air and a second opening at an opposite side of the cylindrical body, said first opening and said second opening being connected to one another through the inside of the motor;

wherein the rotary brush device is operated by operation of the switch.

2. An electric apparatus comprising: a pair of front and rear rollers, a floor detector for detecting a type of floor over which the electric apparatus is rolled, a switch operated by engagement with said floor detector, and a rotary brush device having a cylindrical body having at least one of a brush agitator, a thin-plate agitator and a thin-plate scraper;

a motor disposed in said cylindrical body and for rotating said cylindrical body;

a speed reduction mechanism for reducing rotational speed of said motor;

wherein said motor is disposed on a first end of said cylindrical body and said speed reduction mechanism is disposed on a second end of said cylindrical body;

wherein the rotary brush device is operated by operation of the switch.

3. An electric apparatus comprising: a floor nozzle having disposed therein a rotary brush device having a cylindrical body having at least one of a brush agitator, a thin-plate agitator and a thin-plate scraper;

a motor disposed in said cylindrical body and for rotating said cylindrical body;

a speed reduction mechanism for reducing rotational speed of said motor;

wherein said motor is disposed on a first end of said cylindrical body and said speed reduction mechanism is disposed on a second end of said cylindrical body, the floor nozzle having an intake chamber with a downwardly facing opening, an electric blower for air intake, a dust chamber for capturing dust, and a dust detector provided at a part of an air intake path connecting said intake chamber and the electric blower;

wherein rotation of the cylindrical body of the rotary brush device is controlled in accordance with an output of said dust detector.

* * * * *